US005366276A

United States Patent [19]

Hobson et al.

[11] Patent Number: 5,366,276

[45] Date of Patent: Nov. 22, 1994

[54] ADJUSTABLE ARM REST

[76] Inventors: Blaine M. Hobson, 69 Carmichael Cresc, Log Iko, King City; Douglas G. Broadhead, 25 Bamburgh Cir., Ste. 731, Scarborough, Ontario, M1W 3W2; Donald B. Hovis, 4328 Wellsborogugh Pl., Mississauga, Ontario, all of Canada, L5M 3J4

[21] Appl. No.: 14,444

[22] Filed: Feb. 5, 1993

[51] Int. Cl.[5] ..... A47C 7/54

[52] U.S. Cl. ..... 297/411.35; 297/411.26

[58] Field of Search ..... 297/411.2, 411.21, 411.23, 297/411.25, 411.26, 411.29, 411.3, 411.32, 411.33, 411.34, 411.35, 411.37, 411.38, 115

[56] References Cited

U.S. PATENT DOCUMENTS

| | | | |
|---|---|---|---|
| D. 199,957 | 1/1965 | Bertoldo | 297/411.29 X |
| 1,721,221 | 7/1929 | Jáuregui | 297/411.2 X |
| 2,491,009 | 12/1949 | Lawrence | 297/411.23 |
| 2,774,975 | 12/1956 | Frank | 297/411.2 X |
| 3,233,939 | 2/1966 | Chapman | 297/411.33 X |
| 3,565,484 | 2/1971 | Dargelo | 297/411.32 |
| 4,277,102 | 7/1981 | Aaras et al. | 297/411.38 X |
| 5,143,422 | 9/1992 | Althofer et al. | 297/411.38 X |
| 5,255,956 | 10/1993 | Stevens | 297/411.35 X |

*Primary Examiner*—Kenneth J. Dorner
*Assistant Examiner*—Milton Nelson, Jr.
*Attorney, Agent, or Firm*—Thomas A. O'Rourke

[57] ABSTRACT

Disclosed herein is an arm rest for a chair comprising a frame member and an arm support member, a coupling device to couple the arm support member with the frame member for rotation about an axis, the arm support member having a portion which is offset from the axis, wherein rotation of the arm support member relative to the frame member results in horizontal and vertical adjustment of the arm rest.

5 Claims, 8 Drawing Sheets

ADJUSTABLE ARM REST

BACKGROUND OF THE INVENTION

The present invention relates to chairs and more particularly to the arm rests thereof.

1. Description of the Related Art

Chairs commonly have a seat, a back and a pair of arm rests. In some cases, the arm is fixed to the seat frame and in other cases the arm is movable from an operable position to a storage position, usually by way of a pivot mechanism. The arm rests are generally spaced from the back support and seat a distance which is intended to support the user's arms comfortably, that is at a desirable height and width spacing, without the need for being cramped or outstretched.

Difficulties arise, however, when efforts are made to provide an arm rest that is adjustable for both width and height to accommodate variations in this distance. This is particularly important when dealing with elderly or disabled individuals, whose body shape may change during the progress of their condition.

There remains the need for an improved arm rest which is adjustable in the horizontal and vertical directions which is simple to operate and inexpensive to manufacture.

It is an object of the present invention to provide a novel arm rest.

SUMMARY OF THE INVENTION

Briefly stated, the invention involves an arm rest for a chair comprising a frame member and an arm support member, coupling means to couple the arm support member with the frame means for rotation about an axis, the arm support member having a portion which is offset from the axis, wherein rotation of the arm support portion relative to the frame means results in horizontal and vertical adjustment of the arm support portion.

BRIEF DESCRIPTION OF THE DRAWINGS

Preferred embodiments of the present invention will now be described, by way of example only, with reference to the appended drawings in which.

Figure 1:
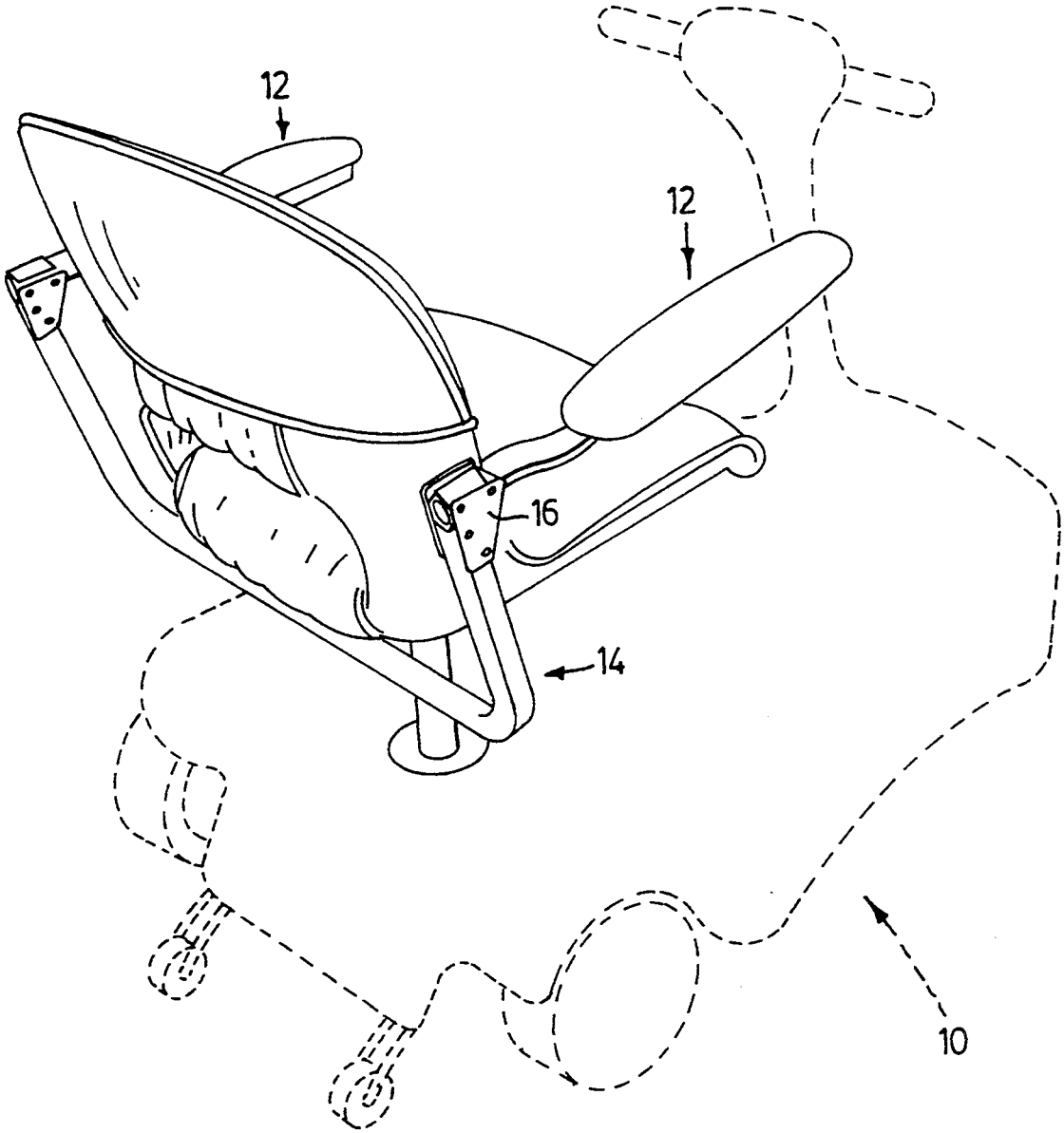
FIG. 1 is a perspective view of a chair.

Referring now to the figures, there is provided a chair 10, in this case a motorized scooter, having a pair of arm rests 12 which are adjustable in both the horizontal and vertical directions. Each arm rest 12 is a frame member 14 with a yoke 16 mounted on its free end. The yoke 16 is formed from a pair of plates 16*a*, 16*b* bolted on either side of the frame member. The frame member 14 is a rectangular cross-sectioned and is mounted to the frame of the wheel chair 10.

The arm rest further includes an arm support member 20 which has a geometric block 20*a* at one end and arranged to engage the yoke 16 in a number of possible positions. In this case, the geometric block 20*a* is six sided. The geometric block has a number of passages joining a corresponding pair of sides or surfaces and dimensioned to receive through bolts or other fasteners shown at 22 to fix the position of the arm support member in the yoke. To that end, the plates 16*a*, 16*b* forming the yoke are also provided with matching holes.

The arm support member 20 is offset from the central line of the geometric block 20*a*. This enables the arm support member to travel in a circular arc, the extent of the arc depending on the degree of the offset. The horizontal and vertical components of the circular arc provide vertical and horizontal adjustment.

The arm support member 20 also has an arm pad 20*b* which is mounted to the arm support member 20 by a number of through bolts 20*c* passing through the arm support member. In this case, the arm support member is provided with a number of passages 20*d* to provide each through bolt with a number of possible orientations according to the position of the geometric block 20*a*.

The arm pad 20*b* may be attached to the arm support member 20 using any one of a number of techniques, including spring loaded pins and the like.

Figure 2:
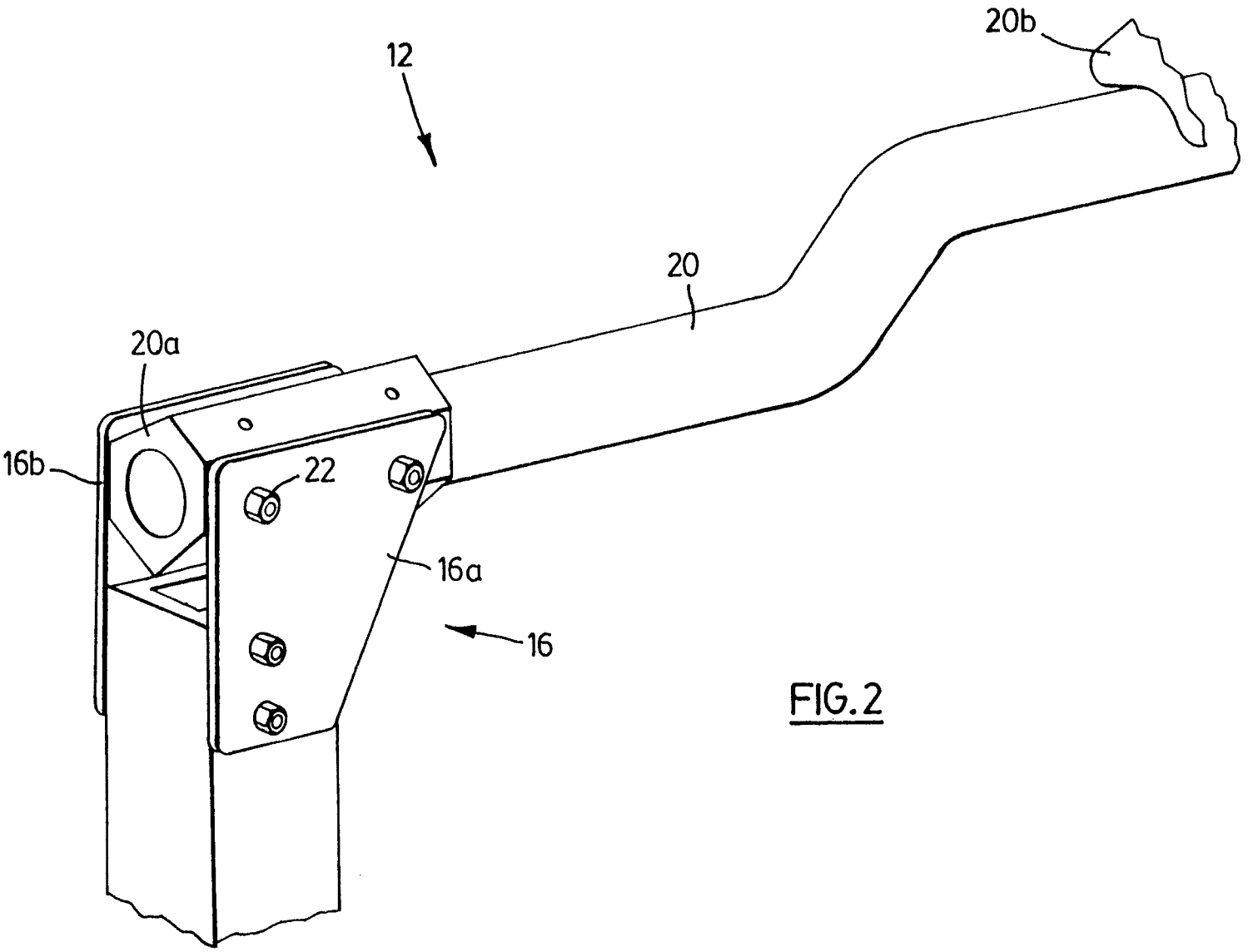
FIG. 2 is a magnified view of a portion of an arm rest on the chair of FIG. 1.
Figure 2A:
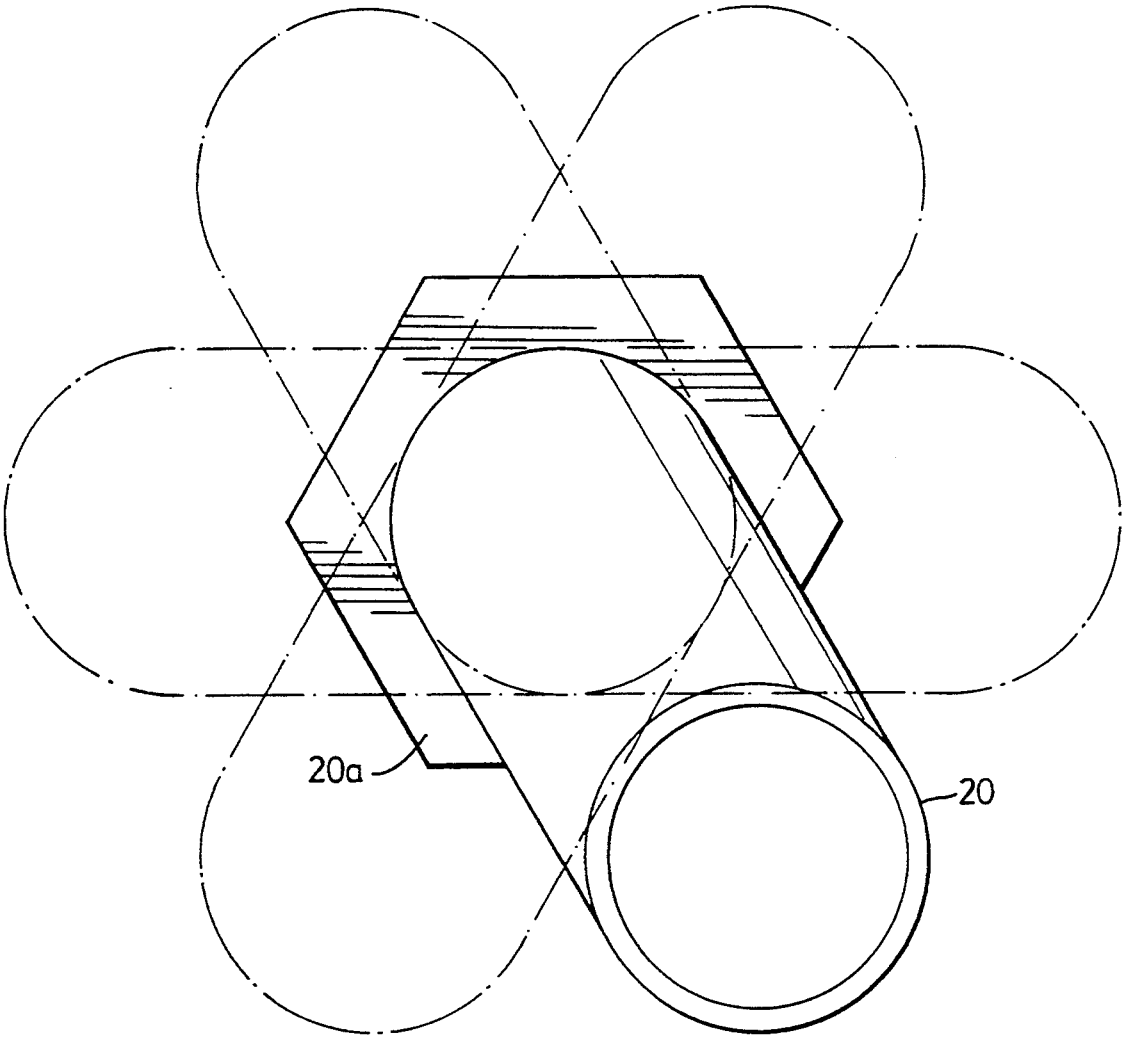
FIG. 2*a* is a schematic view of two portions of the arm rest in alternative positions.
Figure 3:
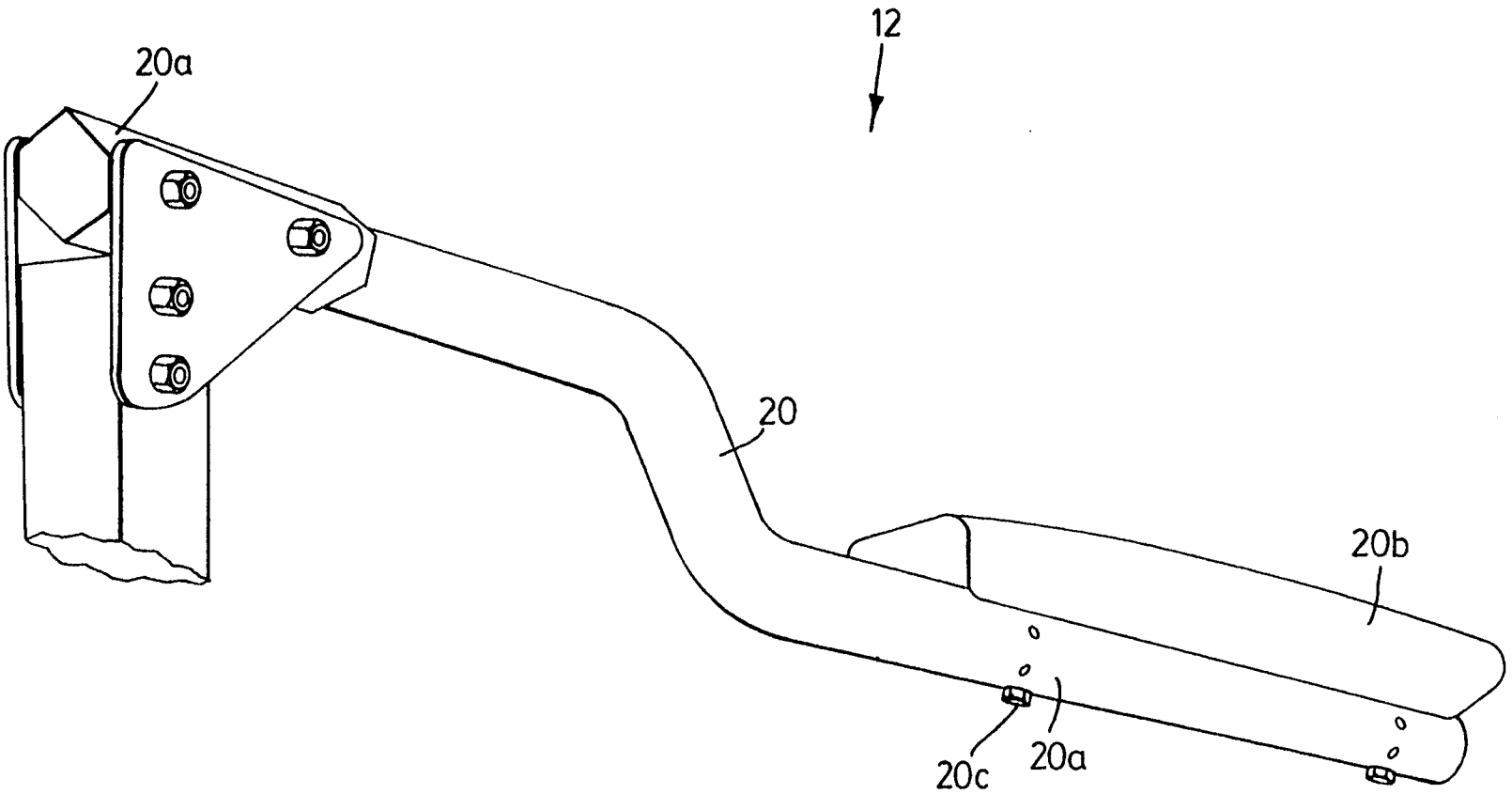
FIG. 3 is another perspective view of the arm rest of FIG. 2.

FIG. 2*a* illustrates the number of positions possible using a six sided geometric block with a one and a half inch offset on the arm support member 20.

Figure 4:
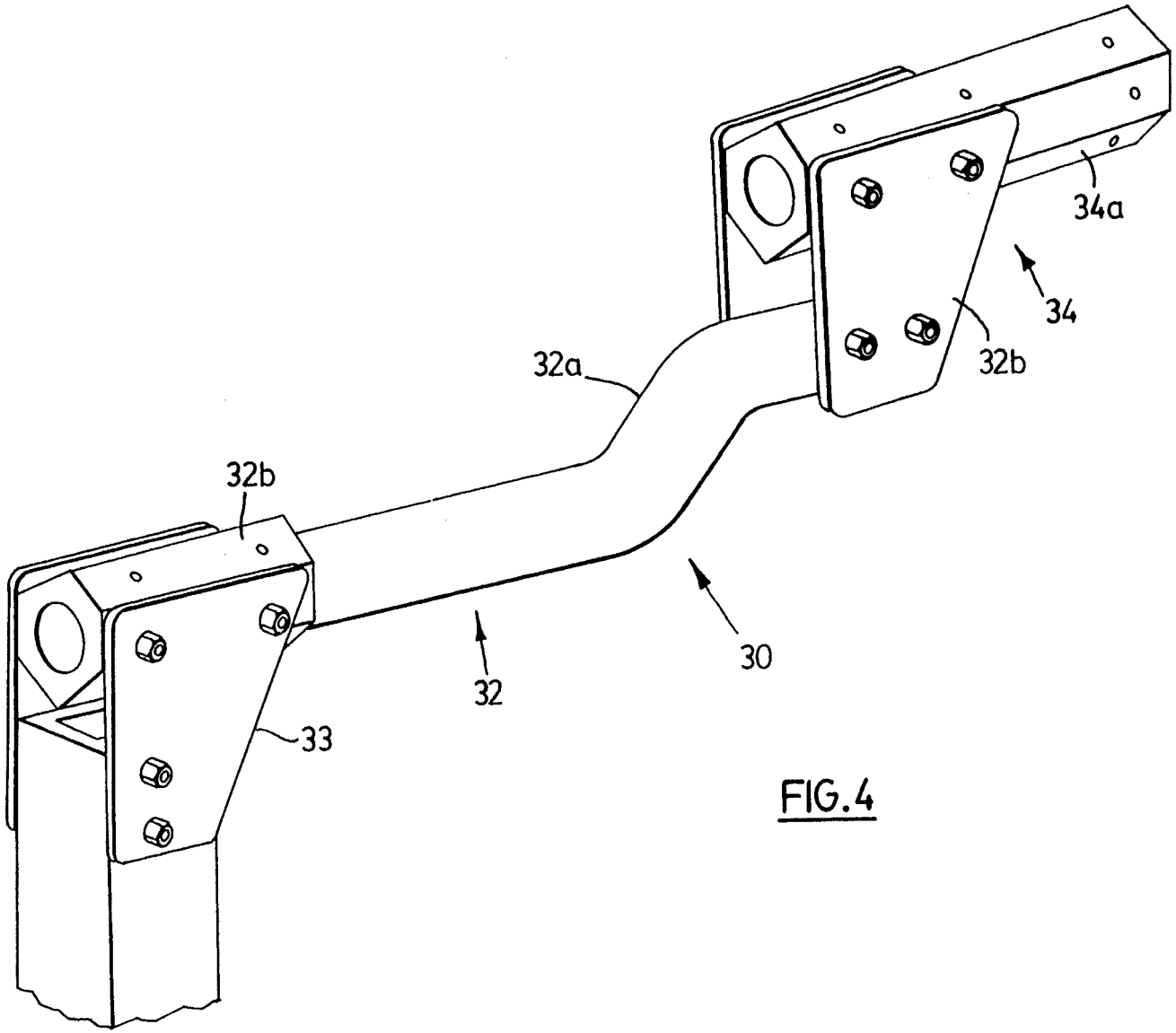
FIG. 4 is a perspective view of a portion of an alternative arm rest.

Referring now to FIG. 4, another arm rest illustrated at 30. The arm rest 30 has two arm support members 32, 34, each of which includes an offset, as for example 32*a*. The arm support member 32 has a geometric block 32*b* at one end which is held within a yoke 33. On the other end, the arm support member 32 has a pair of plates bolted thereto to form a yoke 32*a*. The arm support member 34 in turn has a geometric block 34*a* on one end which together with the yoke 36*a* forms a second geometric block-yoke arrangement. The additional geometric block-yoke arrangement provides the arm rest 30 with an independent adjustment of the arm pad relative to the first geometric block's center line. In this case, the second geometric block-yoke arrangement reduces the compromise of width for height which is inherent with the single block yoke arrangement shown above. In addition, the geometric block 34*a* is longer than the geometric block 32*b* and has a number of pairs of through bolt passages allowing the geometric block 32*b*, and thus the arm pad itself, a degree of longitudinally adjustment relative to the seat and back.

Figure 5:
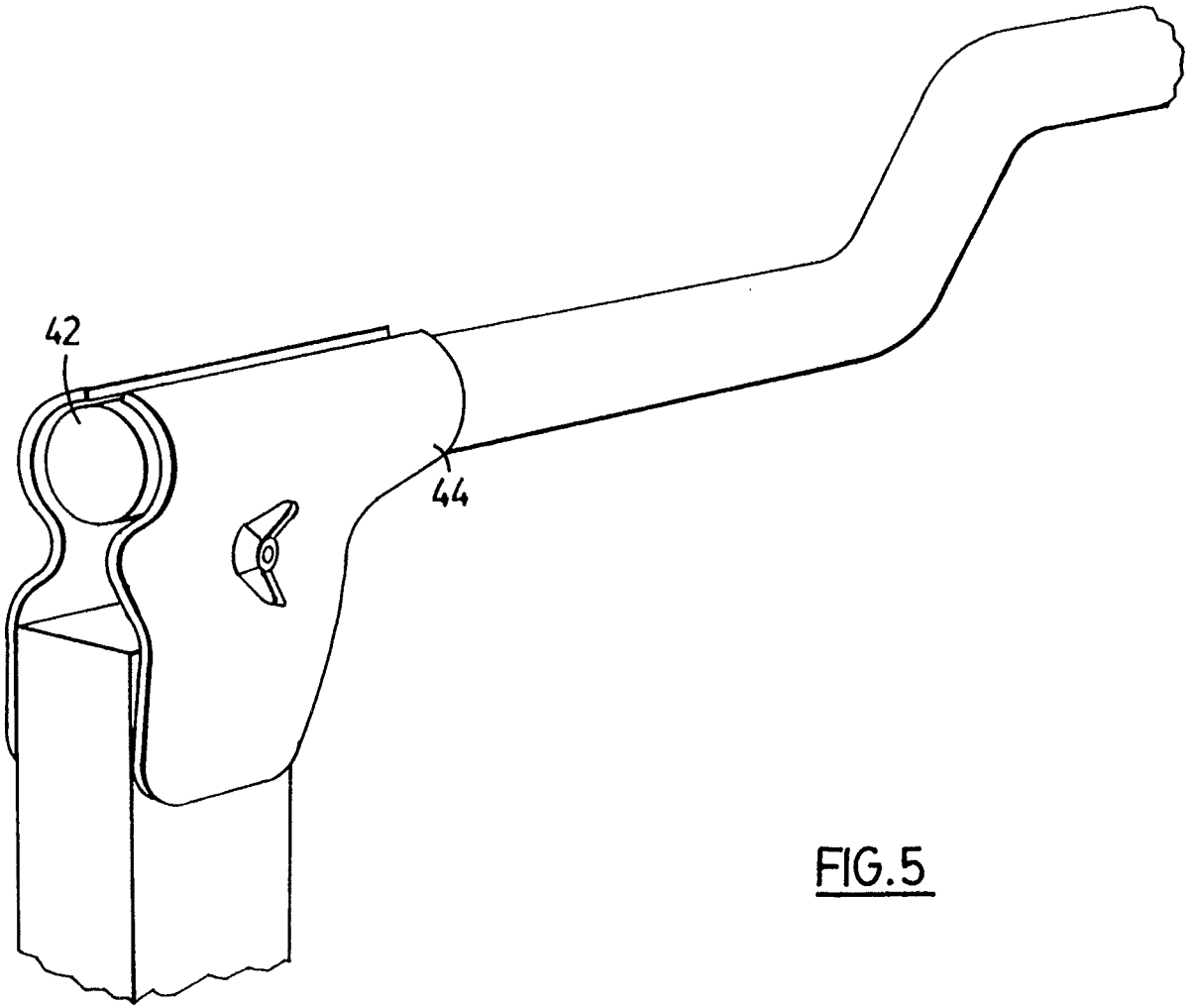
FIG. 5 is a perspective view of a portion of another arm arm rest.

As shown in FIG. 5, the block 42 may simply be a cylinder with no parallel sides and the yoke 44 similarly shaped to embrace the block. This would provide an infinite number of positions. To improve the clamping effect, the surface of the block and yoke my be serrated or otherwise textured. It may have any number of sides depending on the number of positions desired. If desired, the block and yoke may have conical outer and inner faces.

Figure 7:
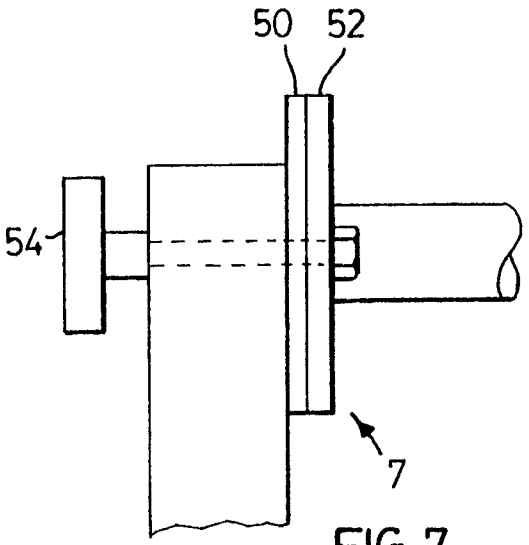
FIG. 7 is a view taken on arrow 7 of FIG. 6.
Figure 6:
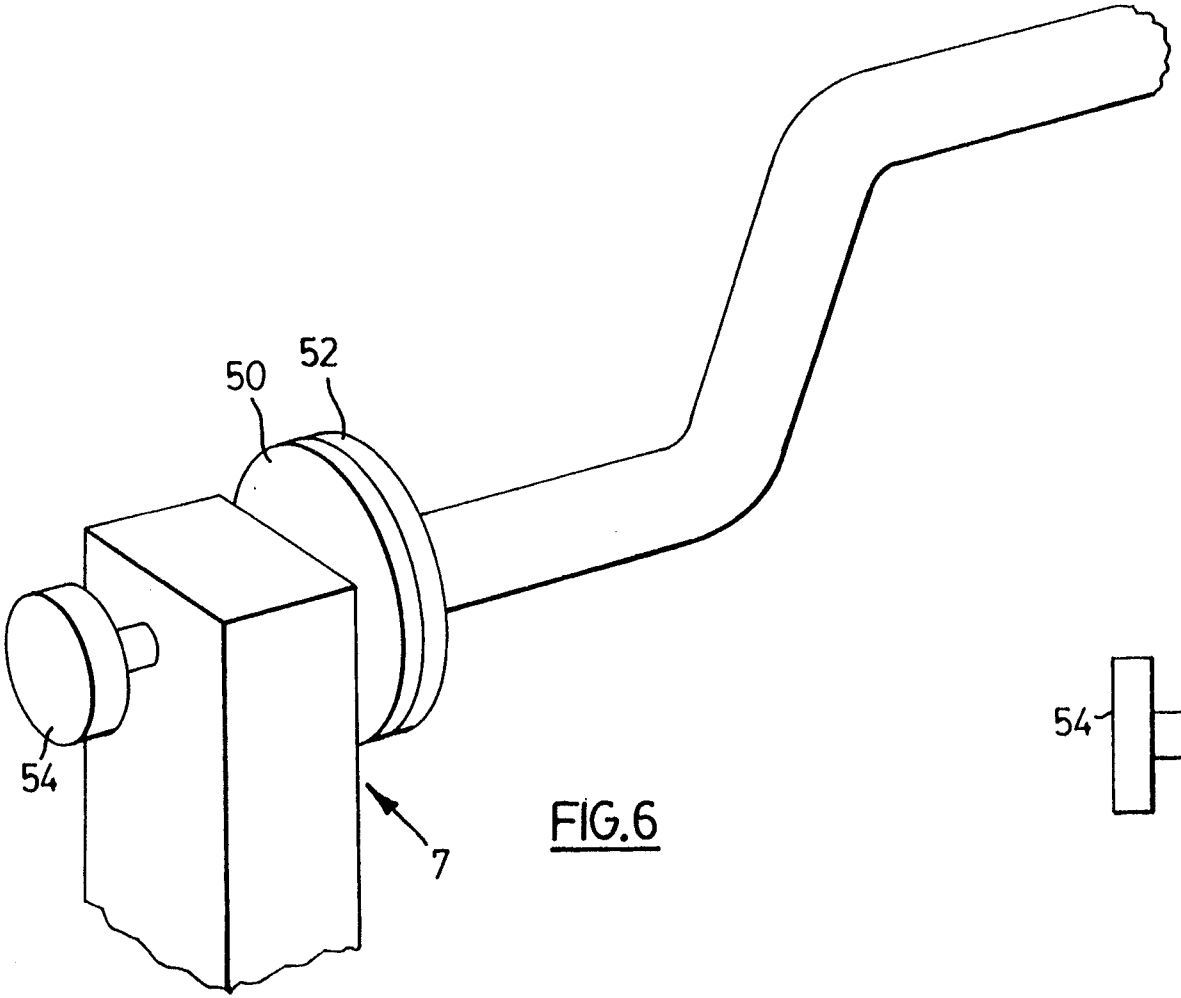
FIG. 6 is a perspective view of a portion of still another arm rest.
Figure 8:
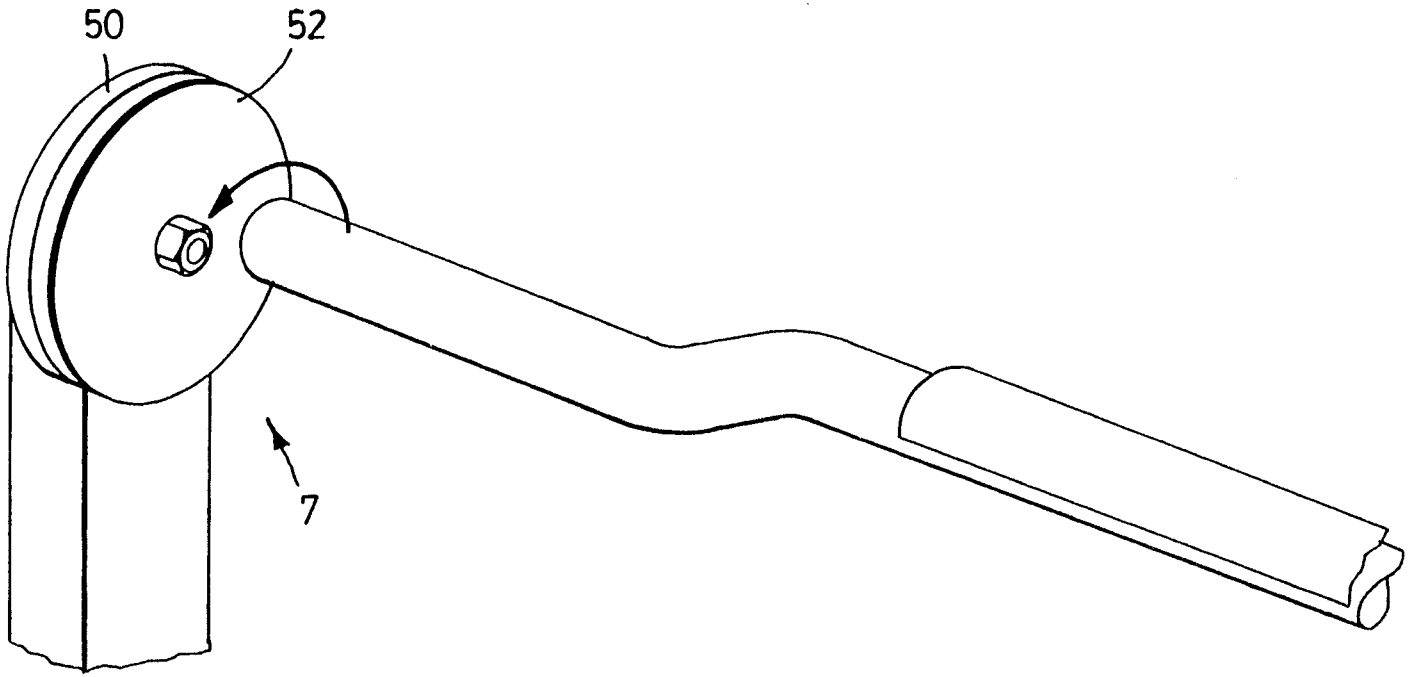
FIG. 8 is an another perspective view of a portion of the arm rest of FIG. 6.

Referring to FIGS. 6, 7 and 8, the block and yoke may be replaced with a pair of discs with appropriate serrated faces, not shown, and held in abutment by way of a threaded fastener 54

We claim:

1. An arm rest for a chair having a frame, said arm rest comprising:

(a) a coupling means rigidly attached to said frame; and (b) a one piece arm support member carried by said coupling means, said arm support member having a first end for attaching to the coupling means and a second end, said arm support member extending along a first generally horizontal longitudinal axis from the first end and along a second generally horizontal longitudinal axis from the second end, said second generally horizontal longitudinal axis being substantially parallel but not co-linear to the first generally horizontal longitudinal axis, and a portion of said arm support member about said second generally horizontal longitudinal axis carrying an arm pad;

wherein the second end and second generally horizontal longitudinal axis may be positioned around the first generally horizontal longitudinal axis to permit horizontal and vertical adjustment of said arm pad to suit the individual needs of an occupant of said chair, by securing the first end of the arm support member in said coupling means in one of a plurality of positions about the first generally horizontal longitudinal axis.

2. An arm rest as defined in claim 1 wherein:

(a) said coupling means includes a yoke joined to said frame;

(b) said first end includes a geometric block joined thereto, said geometric block having an outer surface and said yoke having an inner surface, said outer and inner surfaces being complementary to permit said arm support member to be engaged in said yoke in one of said plurality of positions; and (c) a fastening means for fastening said geometric block and said yoke together to secure said second end in a desired position.

3. An arm rest as defined in claim 2 wherein said arm support member further comprises a mounting means for mounting said arm pad to said arm support member about Said second generally horizontal longitudinal axis, said mounting means being arranged to permit said arm pad to be engaged with said arm support member in one of a plurality of positions on said portion of said arm support member about said second generally horizontal longitudinal axis to suit the needs of the occupant.

4. An arm rest as defined in claim wherein said geometric block has at least one pair of opposed parallel faces.

5. An arm rest as defined in claim 4 wherein said yoke has a pair of inner faces, said a faces being spaced to align with each of said pair of opposed parallel faces on said geometric block.

* * * * *